US008968124B2

(12) United States Patent
Query, Jr.

(10) Patent No.: US 8,968,124 B2
(45) Date of Patent: Mar. 3, 2015

(54) GOAL ANCHORING APPARATUS AND METHOD

(75) Inventor: William Kress Query, Jr., Matthews, NC (US)

(73) Assignee: ABT, Inc., Troutman, NC (US)

( * ) Notice: Subject to any disclaimer, the term of this patent is extended or adjusted under 35 U.S.C. 154(b) by 0 days.

(21) Appl. No.: 12/937,941

(22) PCT Filed: Apr. 14, 2009

(86) PCT No.: PCT/US2009/040553
§ 371 (c)(1),
(2), (4) Date: Jan. 6, 2011

(87) PCT Pub. No.: WO2009/129257
PCT Pub. Date: Oct. 22, 2009

(65) Prior Publication Data

US 2011/0098140 A1 Apr. 28, 2011

Related U.S. Application Data

(60) Provisional application No. 61/124,098, filed on Apr. 14, 2008.

(51) Int. Cl.
*A63B 69/00* (2006.01)
*A63B 63/00* (2006.01)
*A63B 71/02* (2006.01)

(52) U.S. Cl.
CPC ..... *A63B 63/004* (2013.01); *A63B 71/023* (2013.01); *A63B 63/008* (2013.01); *A63B 2071/024* (2013.01); *A63B 2210/50* (2013.01); *A63B 2225/093* (2013.01)
USPC ..... 473/478

(58) Field of Classification Search
USPC ..... 473/477, 476, 415, 478; D30/154; 52/149, 157; 403/187; 126/211, 339; 312/334.41; 410/7; 220/484
See application file for complete search history.

(56) References Cited

U.S. PATENT DOCUMENTS 989,695 A * 4/1911 Clark ..... 292/304
2,883,853 A * 4/1959 Forni ..... 52/21
(Continued)

FOREIGN PATENT DOCUMENTS

DE 198 44 268 A1 3/2000

OTHER PUBLICATIONS

AAE installation instructions, 2004, 1 page.*
(Continued)

*Primary Examiner* — Gene Kim
*Assistant Examiner* — M Chambers
(74) *Attorney, Agent, or Firm* — Moore & Van Allen PLLC

(57) ABSTRACT

Embodiments of the present invention relate to apparatuses and methods for releasably securing a structural member of a movable goal, such as a soccer goal, to a surface, such as the ground. For example, in one embodiment, an apparatus is provided comprising: (1) an enclosure structured to be placed at least substantially below the surface, the enclosure defining a cavity; (2) a goal engaging member movable relative to the surface and structured to engage the structural member of the movable goal; and (3) a tightening mechanism mounted within the enclosure and operatively connected to the goal engaging member, the tightening mechanism being structured to urge the goal engaging member toward the tightening mechanism so that the goal engaging member releasably secures a portion of the structural member of the movable goal.

20 Claims, 14 Drawing Sheets

(56) References Cited

U.S. PATENT DOCUMENTS

| | | | | | |
|---|---|---|---|---|---|
| 3,187,686 | A | * | 6/1965 | De Podesta | 410/12 |
| 3,219,308 | A | * | 11/1965 | Halstead | 249/205 |
| 3,263,853 | A | * | 8/1966 | Smith | 220/484 |
| 3,311,333 | A | * | 3/1967 | Galloway | 52/295 |
| 3,374,008 | A | * | 3/1968 | Blunden et al. | 410/12 |
| 3,416,763 | A | * | 12/1968 | Moreno | 24/68 R |
| 3,848,367 | A | * | 11/1974 | Barnes | 52/157 |
| 3,881,694 | A | * | 5/1975 | Gardner | 24/68 R |
| 4,138,806 | A | * | 2/1979 | Miller | 52/149 |
| 4,243,350 | A | * | 1/1981 | Hall | 410/100 |
| 4,688,843 | A | * | 8/1987 | Hall | 296/65.04 |
| 4,703,917 | A | * | 11/1987 | Tomlinson | 254/369 |
| 4,842,458 | A | * | 6/1989 | Carpenter | 410/3 |
| 5,273,292 | A | | 12/1993 | Pardi et al. | |
| 5,295,664 | A | * | 3/1994 | Kamper | 254/220 |
| 5,338,136 | A | * | 8/1994 | Hetchler | 410/100 |
| 5,586,768 | A | | 12/1996 | Pavonetti | |
| 5,908,274 | A | * | 6/1999 | Silberman | 410/10 |
| 6,287,060 | B1 | * | 9/2001 | Girardin | 410/7 |
| 6,402,643 | B1 | * | 6/2002 | Gill | 473/478 |
| 6,406,230 | B1 | * | 6/2002 | Mason et al. | 410/7 |
| 6,929,571 | B2 | | 8/2005 | Jesch et al. | |
| 7,331,880 | B2 | * | 2/2008 | Rogers | 473/478 |
| 2006/0199674 | A1 | | 9/2006 | Rogers | |

OTHER PUBLICATIONS

AAE 2004 football catalog, 2004, 4 pages.*

Webpage download, portable goal safety, SDAO, 2004, www.sdao.com/ref/Schools/soccer.../portable_goal_safety.pdf; 13 pages.*

Webpage download, Sportsfield2007, product brochure, 2007, http://web.archive.org/web/20070709202434/http://www.sportsfieldspecialties.com/PDF%20Brochures/SSI%20Goal%20Post%20Brochure.pdf; 5 pages.*

Webpage download, Sportsfield2005, 2005 goal picture, 2005, http://web.archive.org/web/20040222010215/http://www.sportsfieldspecialties.com/sportsfield%20specialties%20site%20map.htm; 2 pages.*

Machine translation of Patent DE19844268A1,Sep. 13, 2013, 3 pages.*

Webpage download of correspondence of application EP2265344, 75 pages.*

International Search Report and Written Opinion mailed Nov. 5, 2009.

European Search Report dated Jul. 29, 2011 for EP 09 73 2864.

* cited by examiner

GOAL ANCHORING APPARATUS AND METHOD

FIELD

Embodiments of the present invention generally relate to the field of sporting goal structures, and more particularly, to apparatuses and methods for releasably securing a structural member of a movable goal, such as a soccer goal, to a surface, such as the ground.

BACKGROUND

Fields at athletic facilities are often used for a variety of different sports and events. For example, football fields are often also used as soccer fields. To temporarily transition any field into a soccer field, movable soccer goals are placed on the field. Such movable soccer goals, however, are often prone to tip over, sometimes causing injury to players or others. This may be especially true when young children are playing on the field, as young children may be more likely to climb on, hang on, jump on, bump, or otherwise attempt to disturb the soccer goal. Vandals may also move or steal the movable soccer goals. Furthermore, it takes significant time and effort for facilities personnel to properly align a movable soccer goal on a field relative to the sidelines and the other soccer goal. These problems are not only true for soccer goals, but also pertain to other types of goals and athletic equipment, such as field hockey goals, lacrosse goals, backstops, safety nets, and the like.

Accordingly, there is a long-felt but unmet need to provide a system that enables facility personnel to quickly and easily anchor a movable soccer goal on a field, such as a football field. Previous attempts at securing movable goals involve piercing or puncturing the surface of the playing field with a stake or screw-type device. These devices, however, can cause damage to a playing field when the field consists of natural turf, and these devices cannot be used at all on artificial playing surfaces.

BRIEF SUMMARY OF SELECTED EMBODIMENTS OF THE PRESENT INVENTION

Embodiments of the present invention relate to apparatuses and methods for releasably securing a structural member of a movable goal, such as a soccer goal, to a surface, such as the ground. For example, in one embodiment, an apparatus for releasably securing a structural member of a movable goal relative to a surface is provided. In one embodiment, the apparatus comprises: (1) an enclosure structured to be placed at least substantially below the surface, the enclosure defining a cavity; (2) a goal engaging member movable relative to the surface and structured to engage the structural member of the movable goal; and (3) a tightening mechanism mounted within the enclosure and operatively connected to the goal engaging member, the tightening mechanism being structured to urge the goal engaging member toward the tightening mechanism so that the goal engaging member releasably secures a portion of the structural member of the movable goal.

In one embodiment, the enclosure further comprises a clamping member extending outwardly from the enclosure, and the tightening mechanism is configured to urge the goal engaging member toward the tightening mechanism to thereby releasably secure the portion of the structural member of the movable goal between the goal engaging member and the clamping member. In another embodiment, the enclosure further comprises a pedestal extending into the cavity of the enclosure, the pedestal being structured to support and releasably secure the tightening mechanism. In yet another embodiment, the tightening mechanism comprises a ratcheting mechanism comprising a reel, a flexible belt configured to wind and unwind about the reel, and a handle configured to ratchet the reel in at least one direction.

In one embodiment, the enclosure further comprises at least one track member structured to laterally align the goal engaging member when the goal engaging member moves vertically relative to the enclosure. In another embodiment, the enclosure further comprises an anchoring member extending therefrom, the anchoring member structured for anchoring the enclosure below the surface. In still another embodiment, the anchoring member comprises: (1) at least one support member extending into the cavity of the enclosure, the support member defining an aperture; and (2) an elongate member extending through the aperture, the elongate member defining a protuberance at the distal end thereof.

In one embodiment, the goal engaging member has a generally hook-shaped configuration. In another embodiment, the goal engaging member comprises an alignment pin extending therefrom, the alignment pin being structured to engage a corresponding aperture in a portion of the structural member of the movable goal to align the movable goal relative to the enclosure. In yet another embodiment, the enclosure is structured to receive a least a portion of a generally vertical structural member of a football goal therein, and wherein the goal engaging member is structured to engage a generally horizontal structural member of a movable soccer goal. In still another embodiment, the enclosure comprises a cover, the cover being structured to extend across at least a portion of the enclosure. In another embodiment, the cover further comprises an aperture, the aperture of the cover being structured so that the goal engaging member may move relative to the enclosure through the aperture.

Embodiments of the present invention also provide another apparatus for releasably securing a structural member of a movable goal. In one embodiment, the apparatus comprises: (1) an enclosure configured to be placed at least partially below a surface, the enclosure defining a cavity; (2) a goal engaging member movable relative to the enclosure and structured to engage the structural member of the movable goal; and (3) a tightening mechanism mounted within the enclosure and operatively connected to the goal engaging member, and when the goal engaging member is engaged with the structural member of the movable goal, the tightening mechanism is structured to urge the goal engaging member towards the enclosure to thereby releasably secure a portion of the structural member of the movable goal.

In one embodiment, the enclosure further comprises a pedestal extending into the cavity of the enclosure, the pedestal being structured to support and releasably secure the tightening mechanism. In another embodiment, the tightening mechanism comprises a ratcheting mechanism comprising a reel, a flexible belt configured to wind and unwind about the reel, and a handle configured to ratchet the reel in at least one direction. In yet another embodiment, the enclosure further comprises at least one track member structured to align the goal engaging member when the goal engaging member moves relative to the enclosure.

In one embodiment, the goal engaging member has a generally hook-shaped configuration. In another embodiment, the goal engaging member comprises an alignment pin extending therefrom, the alignment pin being structured to engage a corresponding aperture in a portion of the structural member of the movable goal to align the movable goal relative to the enclosure. In another embodiment, the enclosure is structured to receive a least a portion of a generally vertical structural member of a football goal therein, and wherein the goal engaging member is structured to engage a generally horizontal structural member of a movable soccer goal. In still another embodiment, the enclosure comprises a cover, the cover being structured to extend across at least a portion of the enclosure. In another embodiment, the cover further comprises an aperture, the aperture of the cover being structured so that the goal engaging member may move relative to the enclosure through the aperture.

Embodiments of the present invention also provide a method for releasably securing a structural member of a movable goal. For example, in one embodiment, the method comprises: (1) providing a goal anchoring apparatus comprising a movable goal engaging member structured to engage the structural member of the movable goal, and a tightening mechanism operatively connected to the goal engaging member; (2) positioning the goal engaging member so that the goal engaging member engages the structural member of the movable goal; and (3) actuating the tightening mechanism to urge the goal engaging member towards the tightening mechanism so that the goal engaging member releasably secures the structural member of the movable goal.

BRIEF DESCRIPTION OF THE SEVERAL VIEWS OF THE DRAWINGS

Figure 1:
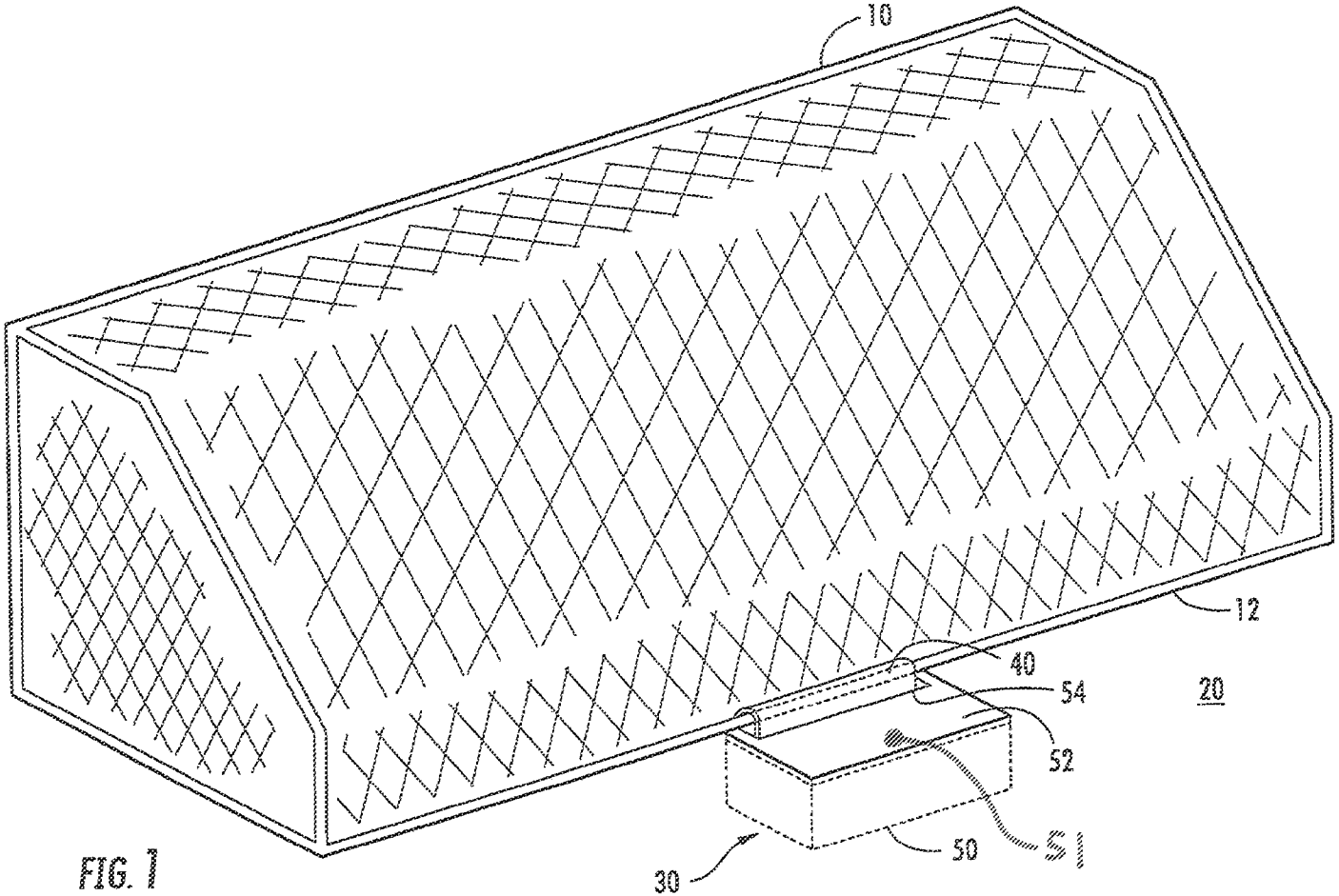
Figure 2:
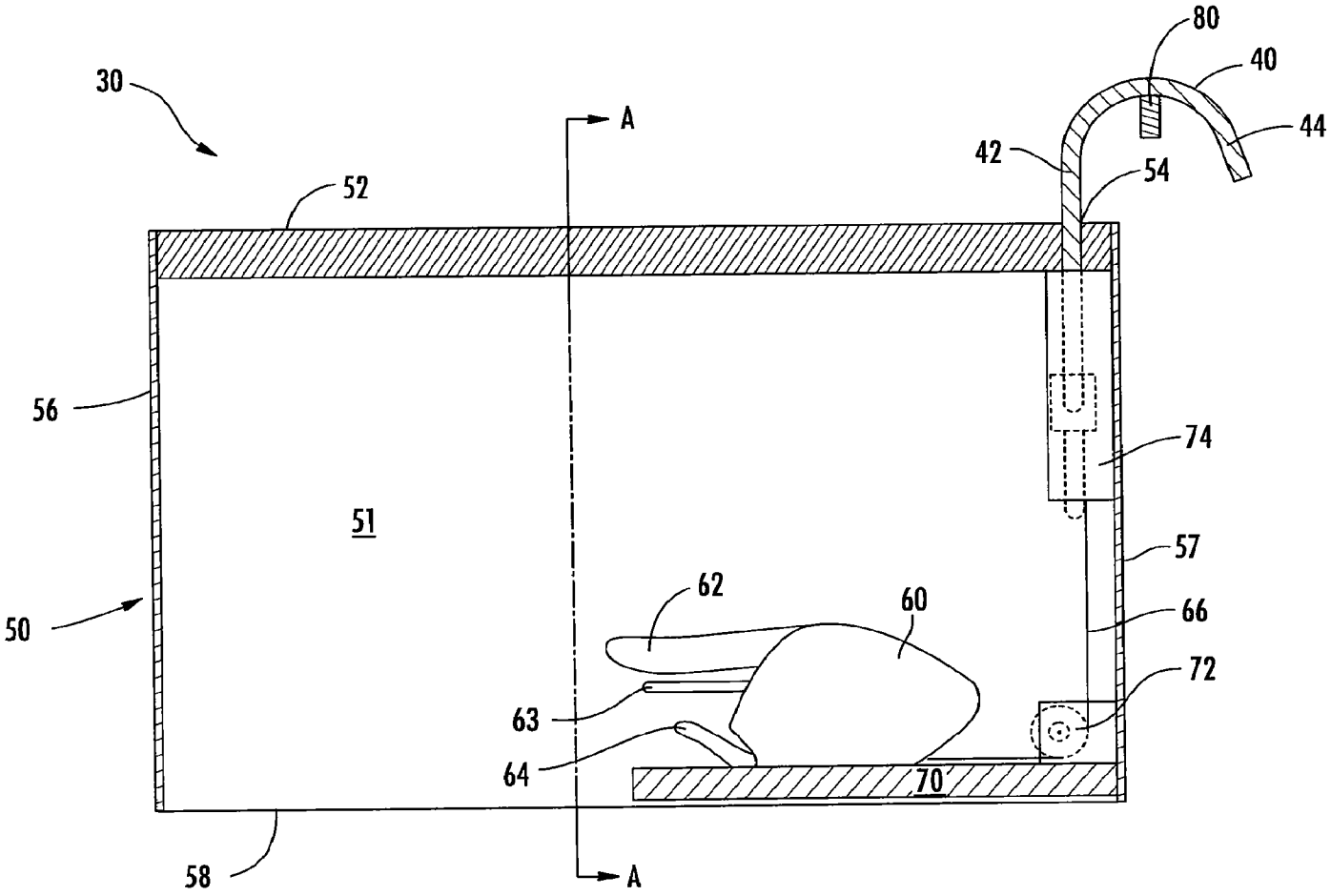
Figure 3:
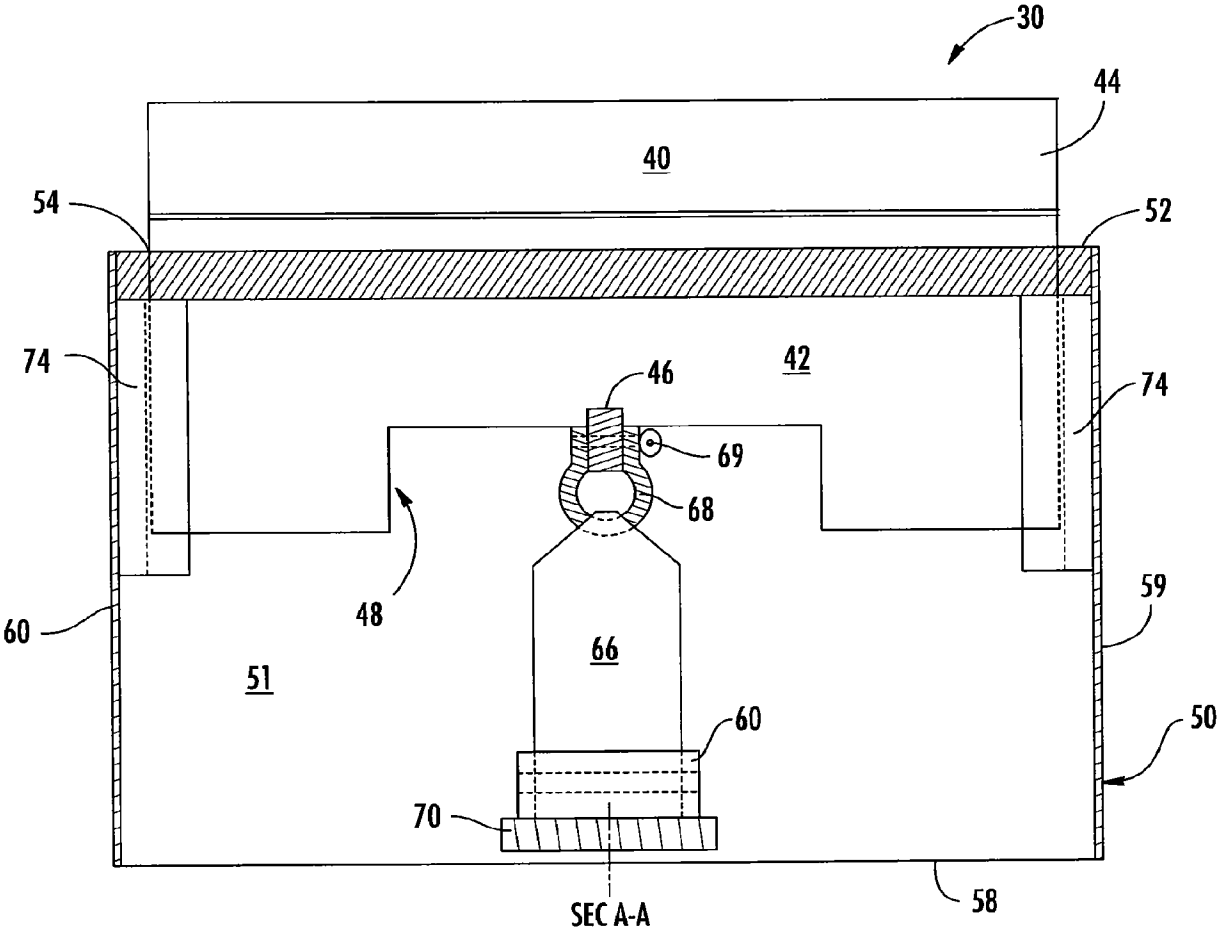
Figure 13:
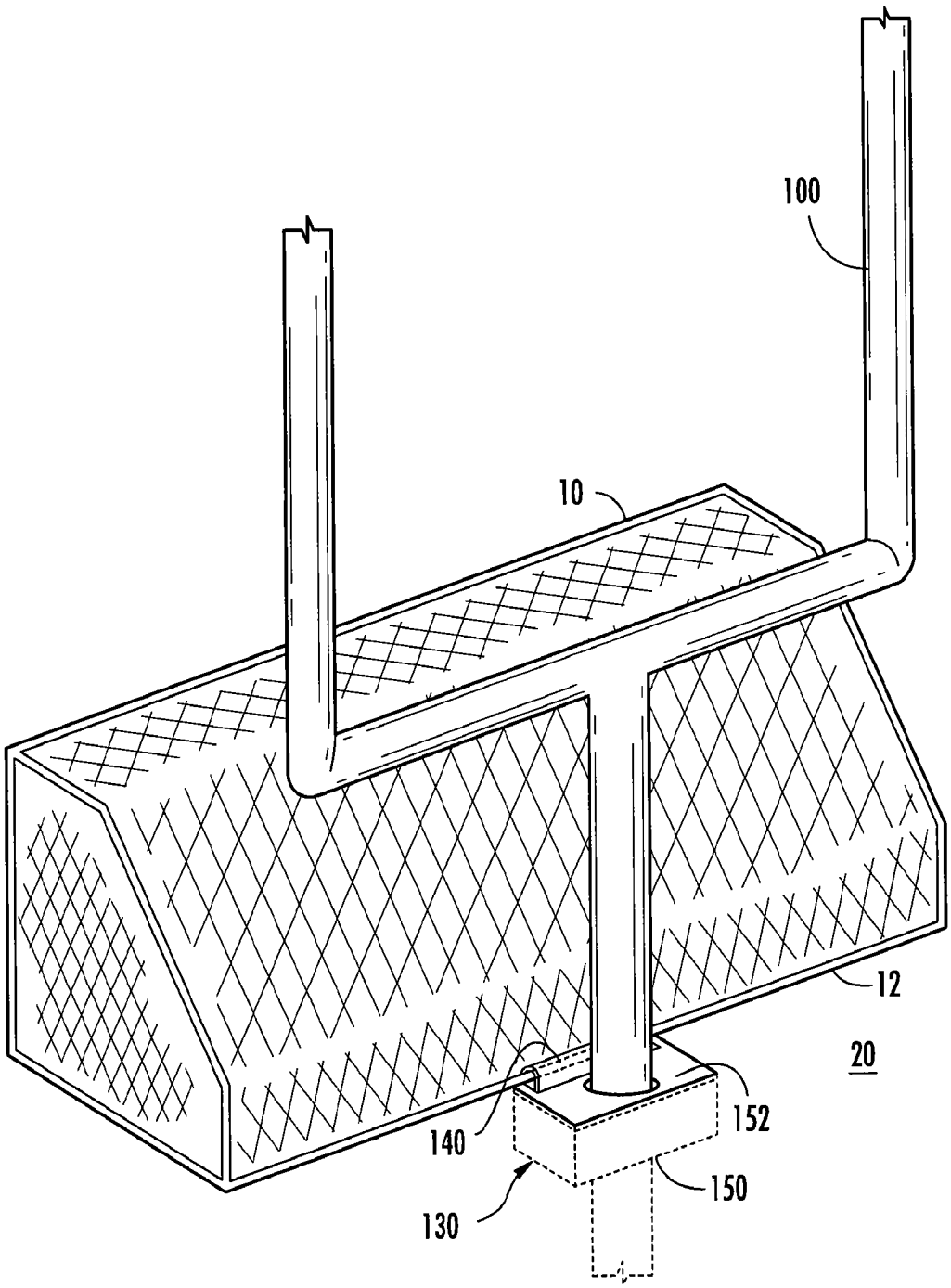
Figure 14:
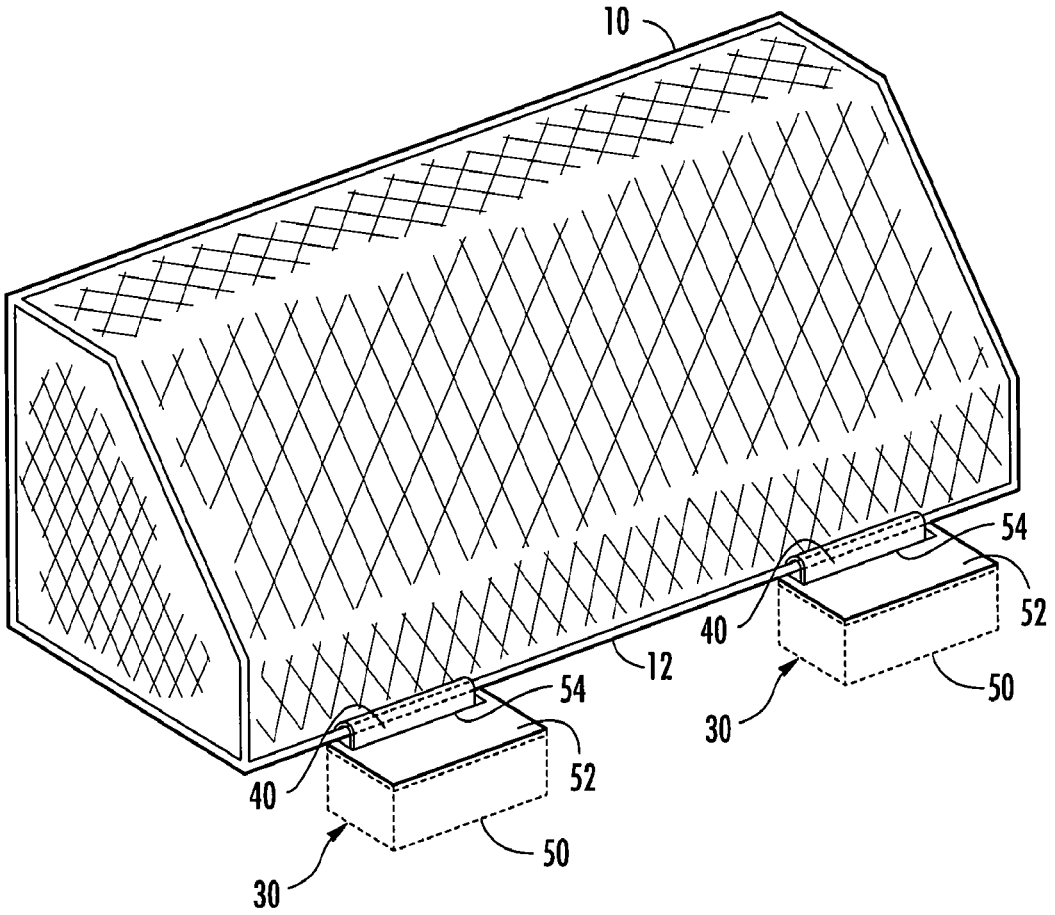

Having thus described embodiments of the present invention in general terms, reference will now be made to the accompanying drawings, which are not necessarily draw to scale, and wherein:

FIG. 1 illustrates a perspective view of a soccer goal anchored to the field using a goal anchoring apparatus in accordance with an embodiment of the present invention;

FIG. 2 illustrates a side section view of the goal anchoring apparatus of FIG. 1, in accordance with an embodiment of the present invention;

FIG. 3 illustrates a rear section view of the goal anchoring apparatus of FIG. 2, in accordance with an embodiment of the present invention;

FIGS. 4-12 illustrate various views of a prototype of the goal anchoring apparatus in accordance with one embodiment of the present invention;

FIG. 13 illustrates a perspective view of a soccer goal anchored to a football goal using a goal anchoring apparatus in accordance with another embodiment of the present invention; and FIG. 14 illustrates a perspective view of a movable soccer goal secured to the field using two goal anchoring devices in accordance with an embodiment of the present invention.

DETAILED DESCRIPTION OF EMBODIMENTS OF THE PRESENT INVENTION

Embodiments of the present invention now will be described more fully hereinafter with reference to the accompanying drawings, in which some, but not all, embodiments of the present invention are shown. Indeed, the present invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa unless explicitly stated otherwise. Also, as used herein, the term "a" and/or "an" shall mean "one or more," even though the phrase "one or more" is also used herein. Like numbers refer to like elements throughout.

Embodiments of the present invention address the need for an apparatus and/or method to anchor and/or releasably secure movable goals. FIG. 1 illustrates a perspective view of a soccer goal 10 anchored to a field 20 using a goal anchoring apparatus 30 in accordance with an embodiment of the present invention. As illustrated, the goal anchoring apparatus 30 includes an enclosure 50 buried at least substantially beneath the surface of the field 20. In an alternate embodiment, the enclosure 50 is buried at least partially beneath the surface of the field 20.

In one embodiment, the enclosure 50 includes a cover 52 for covering the enclosure 50. In an alternate embodiment, the cover 52 is structured to extend across a portion of the enclosure 50. In one embodiment, the cover is generally flush with the surface of the field 20 and is, in some embodiments, covered with artificial turf (not shown) so that the cover 52 blends in with the rest of the field 20. The cover 52 may also be raised above the surface of the field 20. The cover 52 may be plywood, a metallic plate, a polymeric plate, or made from some other material or combination of materials suitable for supporting the artificial turf and the forces that are typically encountered on the field (e.g., the forces associated with athletes playing various sports, vehicles driving over the field, etc.).

A goal engaging member, such as hook-shaped member 40, extends from within the enclosure 50 through an opening, slit, or cutout 54 in the cover 52. In an operating configuration, the hook-shaped member 40 extends above the surface of the field 20 so that the hook-shaped member 40 may engage a structural member of the movable soccer goal 10 by, for example, being placed over the horizontal rear ground bar 12 of the soccer goal 10. A mechanism (not visible in FIG. 1) contained within the enclosure 50 may then be used to urge or pull the hook-shaped member 40 downwards, thereby securing and/or clamping the ground bar 12 of the soccer goal 10 between a portion of the hook-shaped member 40 and the surface of the ground 20 and/or a portion of the enclosure 50. In this way, the movable soccer goal 10 is anchored to the field 20 and substantially prevented from being moved or tipped over.

In some embodiments of the present invention, the enclosure 50 is anchored to the ground with concrete and/or is surrounded by stone, gravel, dirt, or the like (not shown). The dashed lines of the enclosure 50 shown in FIG. 1 are intended to illustrate the portion of the anchoring apparatus 30 that is below grade in the illustrated embodiment of the present invention. In some embodiments, the bolts or other anchoring members extend from the enclosure 50 into the surrounding material, such as the concrete, to better secure or anchor the enclosure 50 within the ground. In addition, such extensions or structures may be removably coupled to the enclosure 50 to permit removal of the enclosure 50 from the ground.

Although this description mainly refers to using embodiments of the present invention in conjunction with a soccer goal 10 and an outdoor artificial turf field 20, it will be understood that other embodiments of the present invention may be used in conjunction with other types of movable goals and other types of surfaces, including outdoor or indoor playing surfaces.

FIGS. 2 and 3 provide a more detailed view of the goal anchoring apparatus 30 in accordance with an embodiment of the present invention. Specifically, FIG. 2 illustrates a side section view of the goal anchoring apparatus 30 illustrated FIG. 1, in accordance with one embodiment of the present invention. FIG. 3 illustrates a rear section view of the goal anchoring apparatus 30 of FIG. 2, in accordance with one embodiment of the invention.

As illustrated in FIGS. 1-3, the enclosure 50 may comprise a front wall 57, a rear wall 56, a first sidewall 59, a second sidewall 60, a lower surface 58, and a cover 52. These surfaces define a cavity 51 that is configured to contain the movable goal securing mechanisms beneath the surface of the field 20 so that the mechanisms are generally out of the way and do not present tripping hazards. Furthermore, when the goal anchoring apparatus 30 is not being used to anchor a movable goal, the goal engaging member, such as the hook-shaped member 40, may also be contained within the enclosure so that the surface of the field 20 is free and clear of any protrusions.

The surrounding walls of the enclosure 50 may be made of a metallic material or other suitable material. In some embodiments of the present invention, the lower surface 58 of the enclosure is completely open or partially open to the material that surrounds the enclosure. Such a design may be useful in that it may permit the drainage of water that enters into the cavity 51. Additionally, it will be understood that in other embodiments of the present invention, the enclosure 50 may comprise more or fewer walls and/or surfaces than those shown in the embodiment illustrated in FIGS. 1-3.

The cover 52 may be supported by a variety of structures. In one embodiment, shelves (not shown) extend from one or more of the enclosures walls, slightly below the upper edges of the walls, to support the cover 52. In one embodiment, the cover 52 is held in place by gravity and the surrounding walls. In other embodiments, however, the cover 52 is coupled to the enclosure 50 by hinges, tracks, or other mechanisms that allow the cover 52 to open by pivoting or sliding relative to the enclosure 50. In some embodiments the cover 52 is bolted to the enclosure 50. In some instances, the enclosure 50 includes a locking mechanism 51 that locks the cover 52 to the enclosure 50. Such a locking mechanism may require a key or other special tool to open the cover 52 so that only authorized personnel are permitted to access the interior of the enclosure 50. A locking mechanism such as this may function to prevent tampering with the goal anchoring apparatus 30 and may also prevent unauthorized persons from moving a goal 10 that is anchored by the anchoring apparatus 30.

Referring again to FIGS. 1-3, in one embodiment of the present invention, the hook-shaped member 40 comprises a hook portion 44 and a substantially planar vertical portion 42. As illustrated in FIG. 2, the hook portion 44 may be curved to essentially match the curvature of a circular cross-sectioned bar 12 of a goal 10. In other embodiments, however, the hook portion 44 may be formed into other hook-like shapes. For example, a more rectangular-shaped hook formed out of three planar portions positioned at right angles to one another is used in some embodiments and may be preferred since such a hook could be used regardless of whether the goal's ground bar 12 has a circular or rectangular cross section.

In one embodiment, the hook-shaped member 40 is comprised of a metallic plate that is bent at one end to form the hook portion 44. In some embodiments, the hook portion 44, or at least the inside surface of the hook portion 44, is padded or otherwise coated with a protective material that functions to prevent the hook-shaped member 40 from scratching the ground bar 12 of the goal 10 and vice versa. As illustrated in FIG. 3, in some embodiments the hook portion 44 of the hook-shaped member 40 extends from one side of the enclosure 50 to the other.

The hook-shaped member 40 is mounted in the enclosure 50 so that it may slide up and down relative to the enclosure 50 in a generally vertical plane. This allows the hook-shaped member 40 to be raised so that the ground bar 12 of the soccer goal 10 may be moved under the hook portion 44 and then lowered so that the hook portion 44 engages the ground bar 12 and clamps or otherwise secures the ground bar 12 between the hook portion 44 and the ground. In the illustrated embodiment, the edges of the vertical portion 42 of the hook-shaped member 40 are inserted into slots in the track members 74 so that the hook-shaped member 40 may then slide up and down in the slots. Accordingly, the track members 74 are structured to laterally align the hook-shaped member 40 when the hook-shaped member 40 moves vertically relative to the enclosure 50. It will be understood that, in other embodiments, the enclosure 50 may comprise track members 74 that are positioned and/or structured differently so as to align the hook-shaped member 40 in a different way as the hook-shaped member 40 moves relative to the enclosure 50.

In the illustrated embodiment, the edges of the vertical portion 42 are sufficiently long to permit the hook-shaped member 40 to slide sufficiently upwards so that the hook portion 44 may clear the top of the goal's horizontal ground bar 12. Also, one or more cutouts, such as the cutout 48 as shown in FIG. 3, may be provided in the vertical portion 42 of the hook-shaped member 40 to provide space for various structures and mechanisms, such as the tightening mechanism (described herein) inside the enclosure when the hook-shaped member 40 is slid downward into the enclosure. Further, the hook-shaped member 40 may be slid upwards in the tracks 74 until it is removed from the tracks. Also, the hook-shaped member 40 may be laid down in the enclosure 50 completely within the cavity 51 of the enclosure 50 when the goal anchoring apparatus 30 is not being used to anchor a goal 10.

In other embodiments of the present invention, other structures are provided to permit the hook-shaped member 40 to slide upwards and downwards relative to the enclosure 50 and allow the hook-shaped member 40 to be moved below grade when not in use. For example, in another embodiment of the present invention, the hook-shaped member 40 includes a pin or wheel coupled to each side of the vertical portion 42, where each pin or wheel is received within a track. The track allows the pin or wheel to move upwards and downwards relative to the enclosure 50. In some embodiments, the pins or wheels also allow the hook-shaped member 40 to pivot relative to the track. In this way, when the goal securing apparatus 30 is not in use, the hook-shaped member 40 may be pivoted to a more horizontal configuration so that it is contained completely within the cavity 51, below the cover 52.

FIGS. 1-3 further illustrate an embodiment of the tightening mechanism that is structured to releasably secure the bar 12 of the goal 10. As illustrated, the tightening mechanism is mounted within the enclosure 50 and is structured to urge the hook-shaped member 40 towards the tightening mechanism (and/or the enclosure 50) when the hook-shaped member 40 is engaged with the bar 12 of the goal 10. In the illustrated embodiment, the tightening mechanism comprises a ratcheting mechanism 60 that comprises a reel (not shown) with a flexible belt 66 wound about the reel. The flexible belt 66 extends generally horizontally from the ratcheting mechanism 60 around a pulley or wheel 72 and then is coupled to the lower edge of the hook-shaped member 40. Using the handles 62, 63, and/or 64 of the ratcheting mechanism 60, a user may lock the reel in the ratcheting mechanism 60, release the reel, and/or ratchet the reel in one direction. For example, a user may release the reel in the ratcheting mechanism 60 to provide slack in the belt 66. The user may then place the hook-shaped mechanism 40 into the tracks 74 and over a bar 12 of the goal 10. The user may then use the handles of the ratcheting mechanism to take up the slack in the belt 60. Once the slack in the belt 66 is taken up, the user may tighten the belt 66 using the handles to ratchet the reel in the ratcheting mechanism 60 in one direction. In this way, the hook portion 44 of the hook-shaped member 40 is tightened down around the bar 12 of the goal 10. In the illustrated embodiment, the belt 66 must be sufficiently long to allow a user to remove the hook-shaped member 40 from the tracks 74 and then lay the hook-shaped member 40 down within the enclosure 50. In one embodiment of the present invention, the ratcheting mechanism 60 is a commercially available BoatBuckle® provided by Indiana Mills & Manufacturing, Inc. (IMMI®) of Westfield, Ind.

As illustrated in FIGS. 2-3, in one embodiment, the end of the belt 66 is coupled to the hook-shaped member 40 by a ring 68 and a pin 69 that is inserted through an aperture in a member 46 extending from the lower edge of the hook-shaped member 40. In other embodiments, the end of the belt 66 may be coupled to the hook-shaped member 40 using other mechanisms. Furthermore, although a belt 66, such as a seat-belt-like belt, is described, other embodiments of the present invention may use other types of belts or lines, such as rope, chain, or the like, with other types of ratcheting or tightening systems, as will be apparent to one of ordinary skill in the art in view of this disclosure. Likewise, although a pulley or wheel 72 is described, other embodiments of the present invention may use a rod or pin with a circular cross section instead of the pulley or wheel 72.

In the illustrated embodiment, the ratcheting mechanism and the wheel 72 are mounted or otherwise releasably secured to a support surface 70, such as a pedestal, that extends from the front wall 57 at least partially above the lower edge of the front wall 57. This type of configuration, where the lower side 58 of the enclosure 50 is open to the material surrounding the enclosure, may be useful since it permits drainage of water that enters the cavity 51. However, the support surface 70 raises the ratcheting mechanism 60 slightly above the bottom of the cavity to protect the ratcheting mechanism 60 from water that may accumulate in the cavity during, for example, a heavy rain storm. However, as will be apparent to those skilled in the art in view of this disclosure, in other embodiments the ratcheting mechanism 60 may be mounted in other ways and in other locations within the enclosure 50.

FIG. 2 also illustrates a pin 80 in the hook portion 44 of the hook-shaped member 40. In one embodiment, the pin 80 may be used to align the goal 10 side-to-side relative the field 20. For example, in one embodiment, the goal anchoring device 30 is centered on the field between the sidelines of the playing field. If the pin 80 is located at the center of the securing apparatus 30, and if a corresponding hole is placed in the bar 12 of the goal 10 at the center of the goal 10, then aligning and securing the goal 10 so that the pin 80 is received in the hole in the bar 12 will ensure that the goal 10 is in the center of the field 20 and will prevent the goal from being moved side to side on the field 20. This pin 80 may be used in some embodiments of the present invention, while other embodiments of the present invention may not utilize such a pin 80. In one embodiment, the pin 80 is separate from the hook-shaped member 40 and is removably received through an aperture in the hook-shaped portion 40. In other embodiments, the pin is welded to the hook-shaped member 40 or coupled to the hook-shaped portion 40 in other ways. It will be understood that, in other embodiments, other kinds of alignment structures may be used, that those structures may be positioned differently on the member 40 and/or bar 12, and/or that those structures may operate to align the goal 10 in a different way.

It will be understood that, in some embodiments, the goal anchoring apparatus 30 is configured such that a user may anchor a goal 10 by hand, without the use of any tools.

Figure 4:
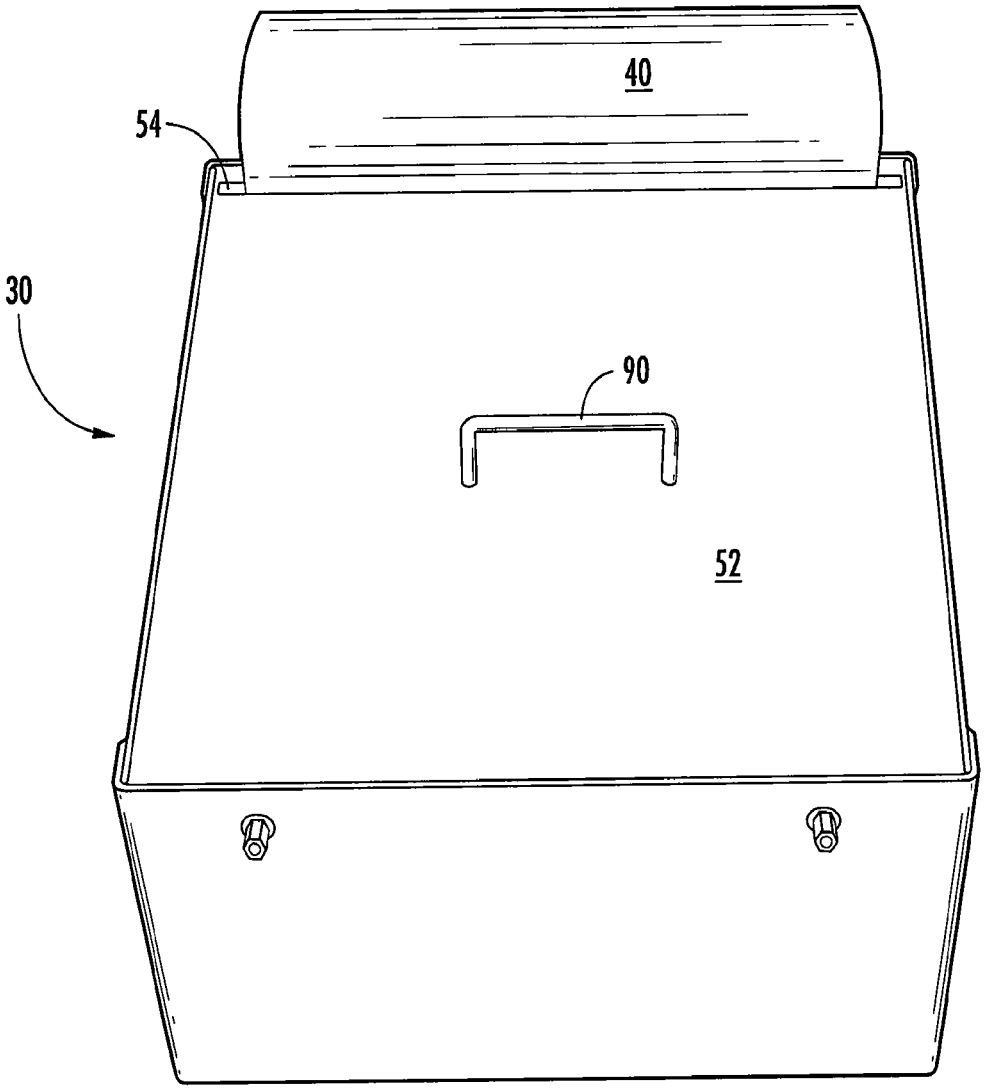
Figure 5:
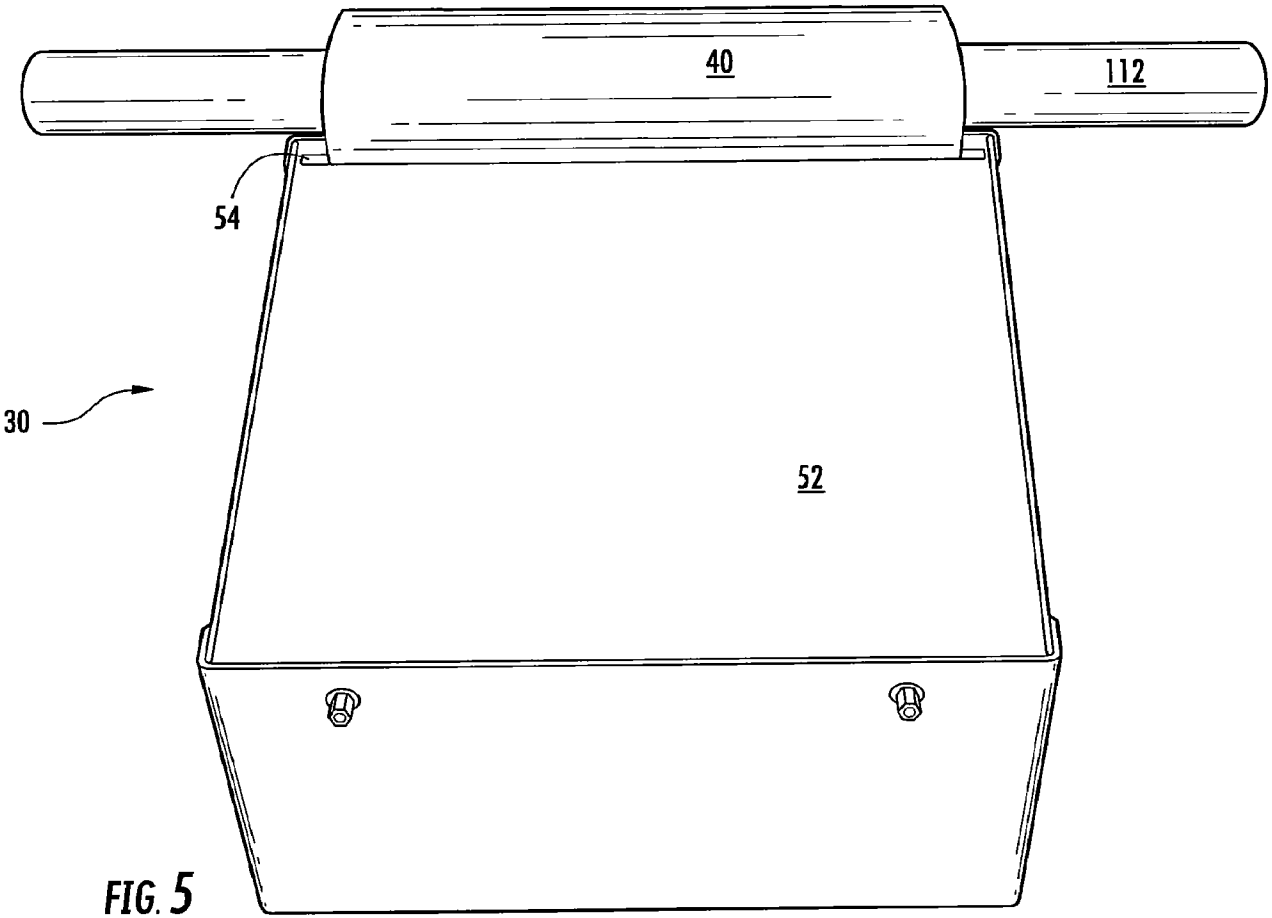

FIGS. 4-12 illustrate various views of a prototype goal anchoring apparatus 30 in accordance with one exemplary embodiment of the present invention. FIG. 4 illustrates a rear view of the goal anchoring apparatus 30 showing the apparatus 30 with the cover 52 in place. Although the prototype has a handle 90 extending from the cover 52, typical embodiments of the present invention will not have such a handle because such a handle may present a tripping hazard on the field 20. Other embodiments of the present invention may provide a small slot in the cover 52 to allow a user to insert a hand or tool into the slot to facilitate lifting of the cover 52 from the enclosure 50. FIG. 4 also shows the hook-shaped member 40 extending above the surface of the cover 52. FIG. 5 illustrates the same view as FIG. 4, but shows a pipe 112 held by the hook-shaped member 40 to simulate the ground bar 12 of a goal 10 shown in FIG. 1.

Figure 6:
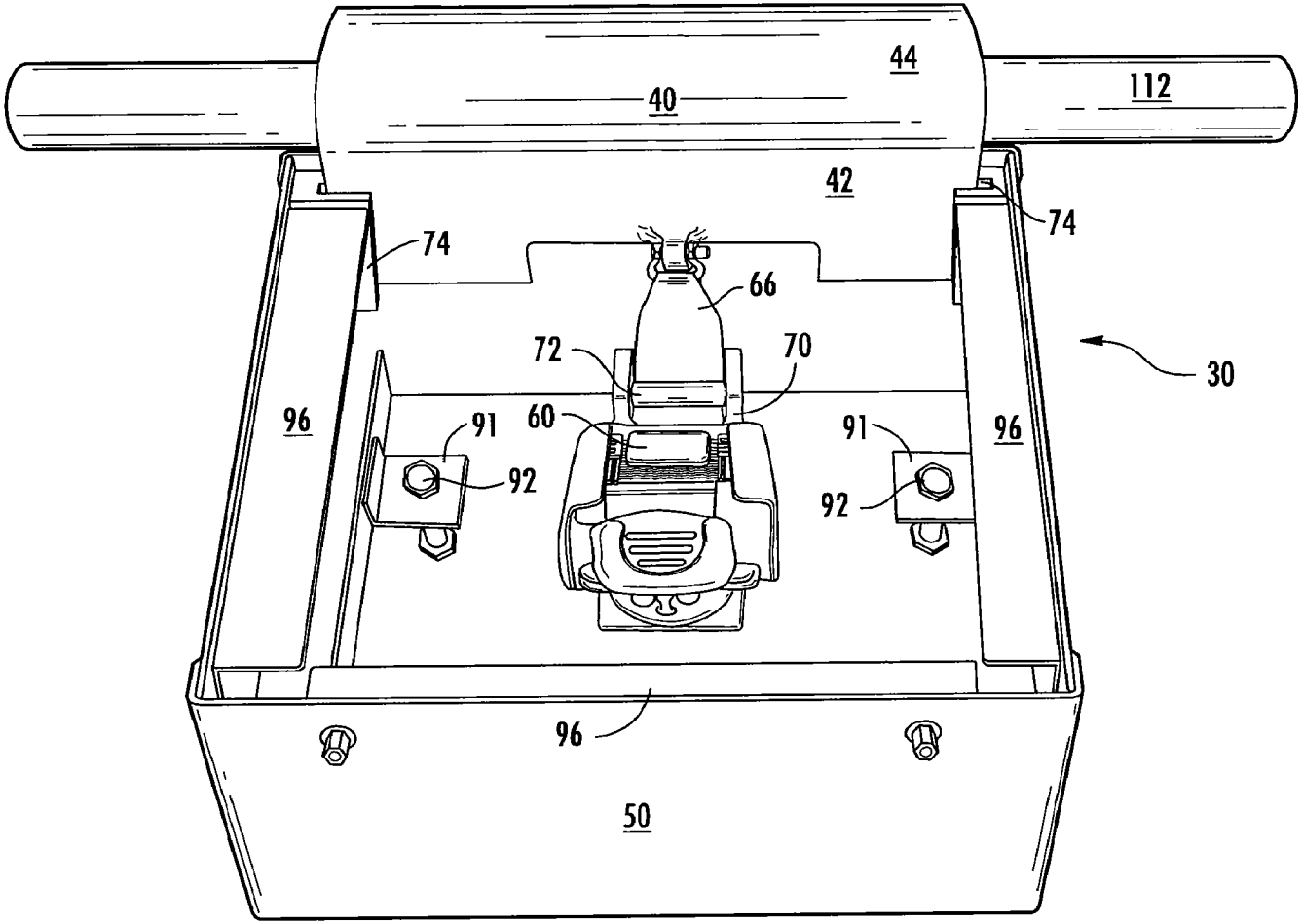

FIG. 6 illustrates the same view as in FIG. 5, except that the cover 52 has been removed to show the inside of the enclosure 60, in accordance with one embodiment of the present invention. As can be seen in this figure, the lower side of the enclosure 50 is open. Also visible are angles 91 that, in one embodiment, are welded to the sides of the enclosure 50. As shown, these angles 91 define an aperture therethrough so that a bolt 92 may extend through the aperture and below the bottom of the enclosure 50. Each of the bolts 92 may be anchored in concrete or some other material or structure below the enclosure 50. Further, as shown, each of the bolts 92 may also comprise at least one protuberance at the distal end thereof to thereby better secure the bolts 92 in the material adjacent the enclosure 50. In some embodiments, the enclosure 50 may be anchored to the ground but still be removable by removing the nuts that couple the angles 91 to the bolts 92. It will be understood that other types and numbers of angles or other support members may be used in other embodiments. It will also be understood that other types and number of bolts or other anchoring or elongate members may be used in other embodiments.

In some embodiments, the height of the enclosure 50 relative to the field 20 is adjustable. For example, in one embodiment of the present invention, the four bolts 92 illustrated in FIGS. 6-12 are used to adjust the height of the four corners of the enclosure 50 relative to the surrounding concrete, turf, field, or the like. In one embodiment, two nuts are threaded onto each bolt 92, one above each angle 91 and one below each angle 91. The nuts below the angles 91 may then be used to adjust the height of the enclosure 50. With the bolts 92 anchored below the enclosure 50, turning the nuts located below the angles 91 in one direction raises the enclosure 50, and turning these nuts in the other direction lowers the enclosure 50. The nuts above the angles 91 are used to secure the enclosure to the bolt 92. This adjusting feature, or a similar adjusting feature, allows a user to adjust the enclosure 50 so that the cover, or a material on top of the cover, is below, above, or flush with the field 20 or other surface surrounding the enclosure 50.

Figure 7:
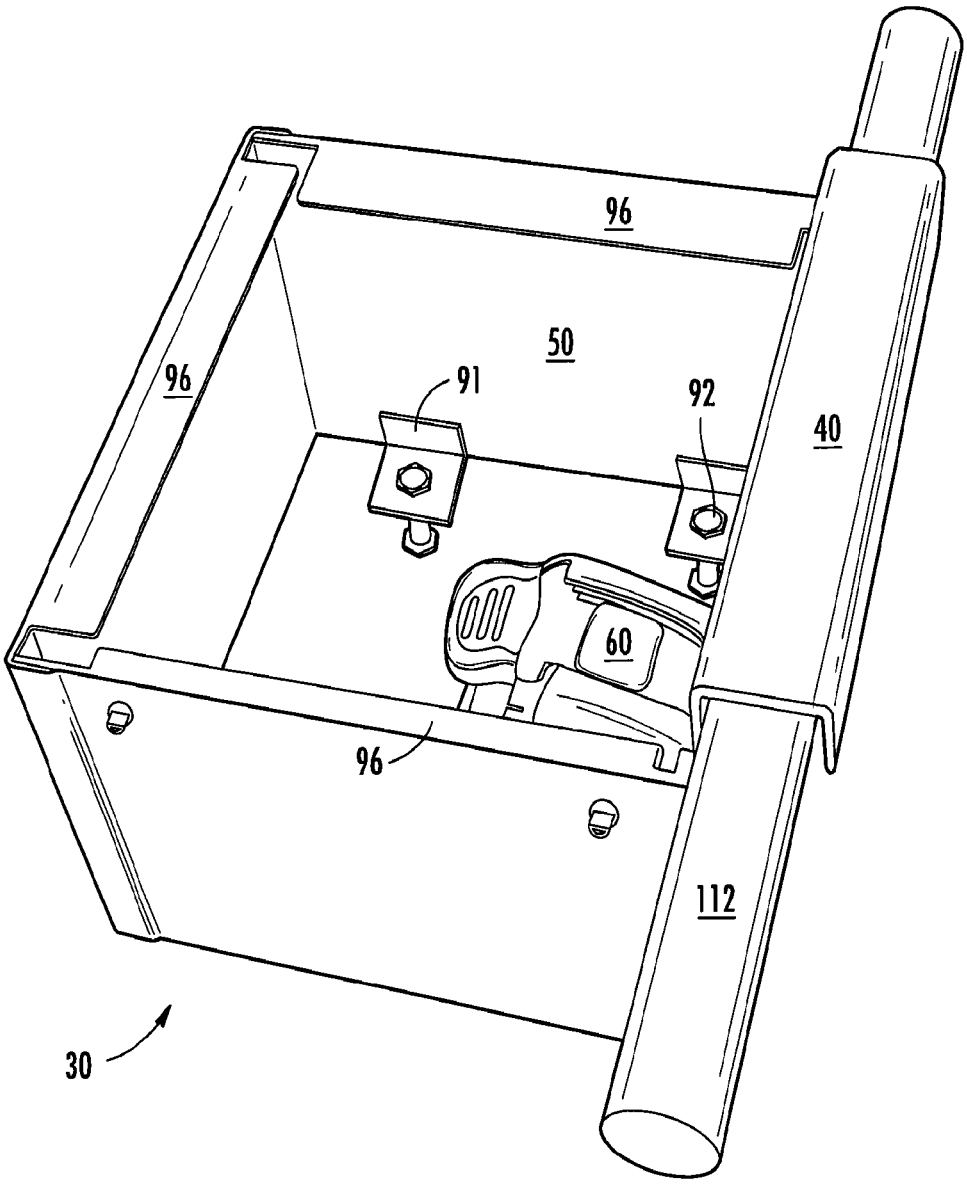
Figure 8:
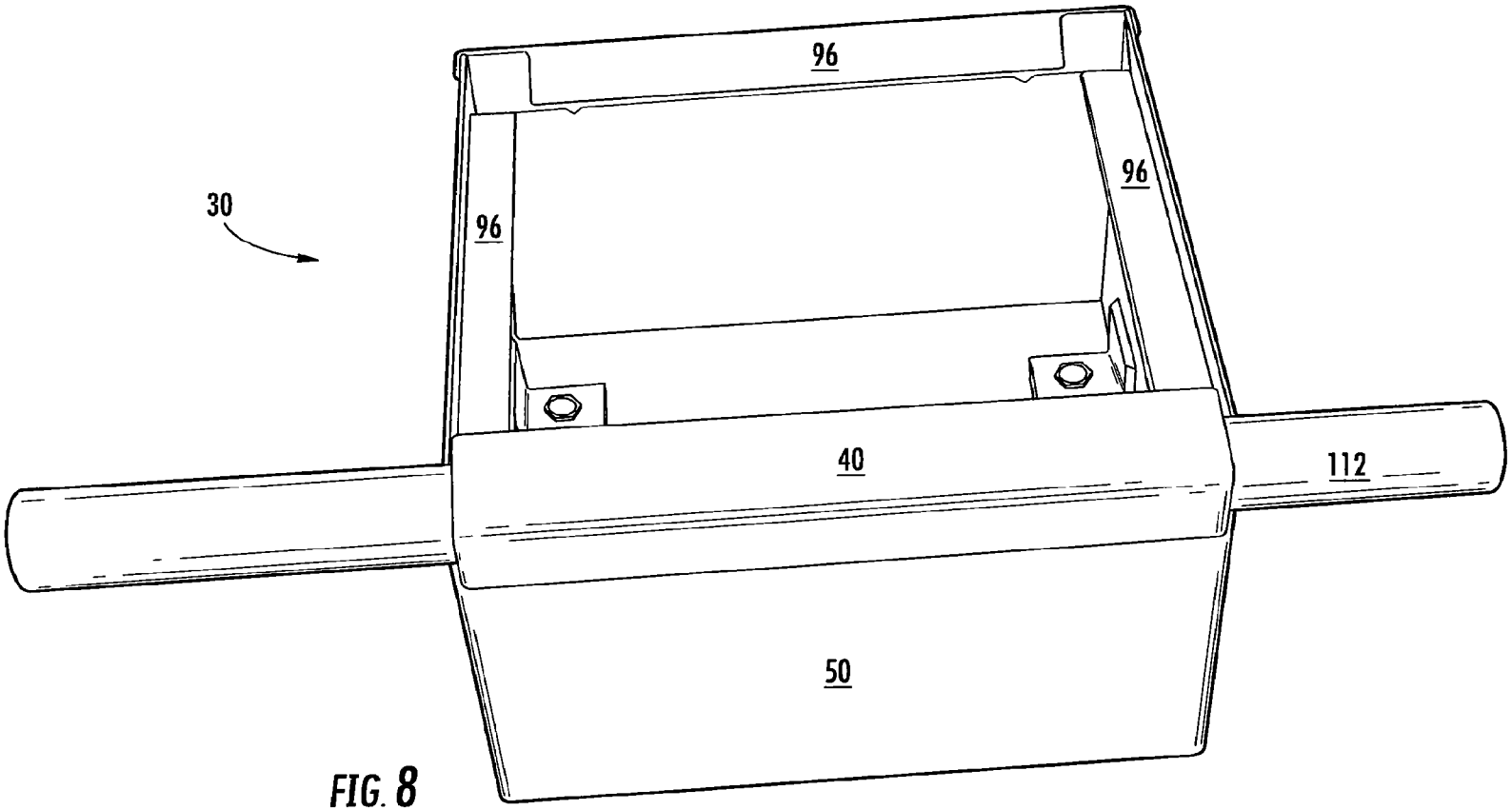

FIG. 6 further depicts the ratcheting mechanism 60, the belt 66, the pulley 72, and the ratcheting mechanism support surface 70. Tracks 74 are also visible, as are the slots therein for slidably receiving the edges of the hook-shaped member 40. FIG. 6 also depicts shelves 96 that support the cover 52 (not shown). FIGS. 7 and 8 illustrates the goal anchoring apparatus 30 from the side and front, respectively, with the cover 52 removed.

Figure 9:
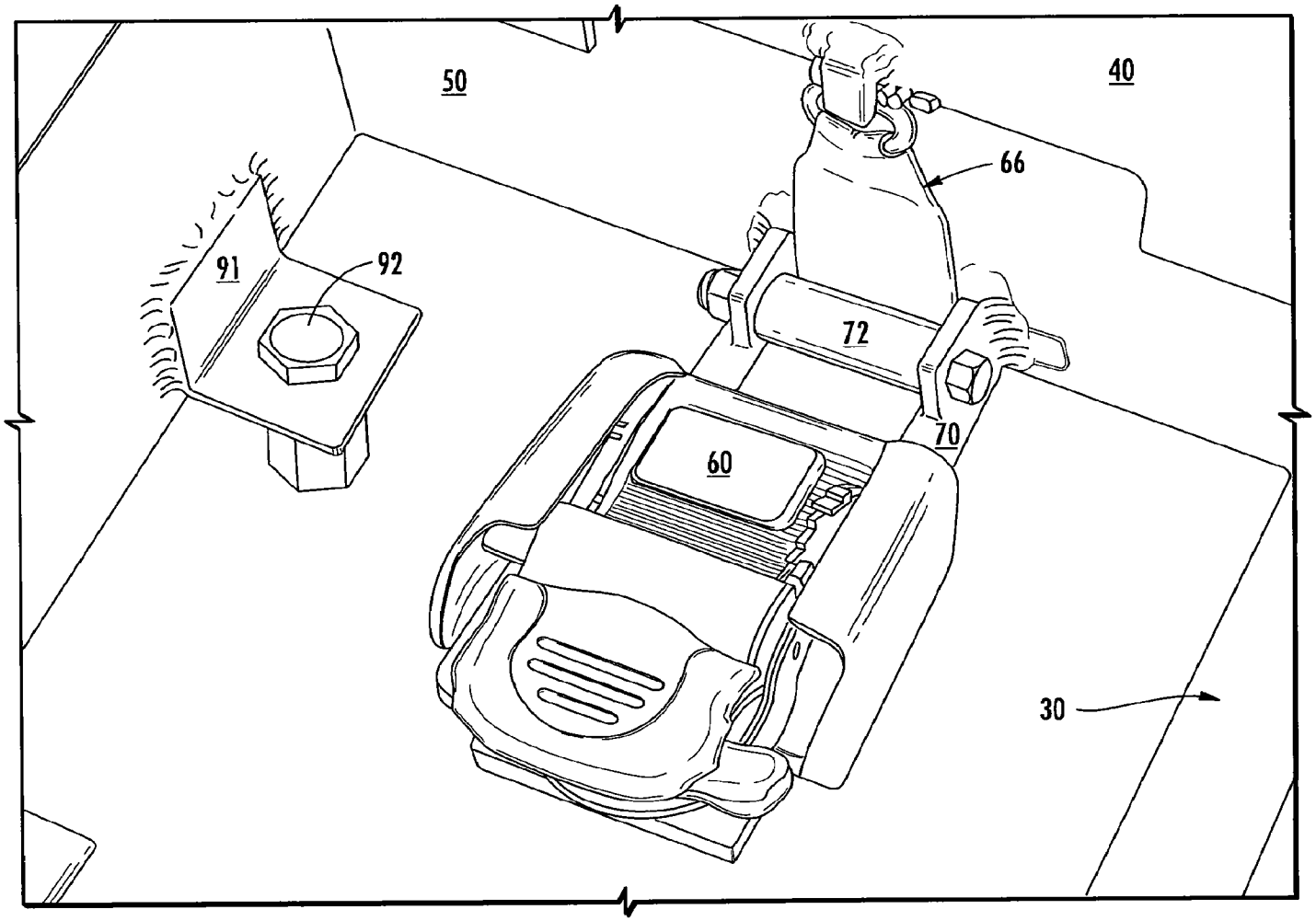

FIG. 9 illustrates a close-up view of the ratcheting mechanism 60, the belt 66, and the pulley 72. Also visible are the angles 91, bolts 92, and the ratcheting support surface 70.

Figure 10:
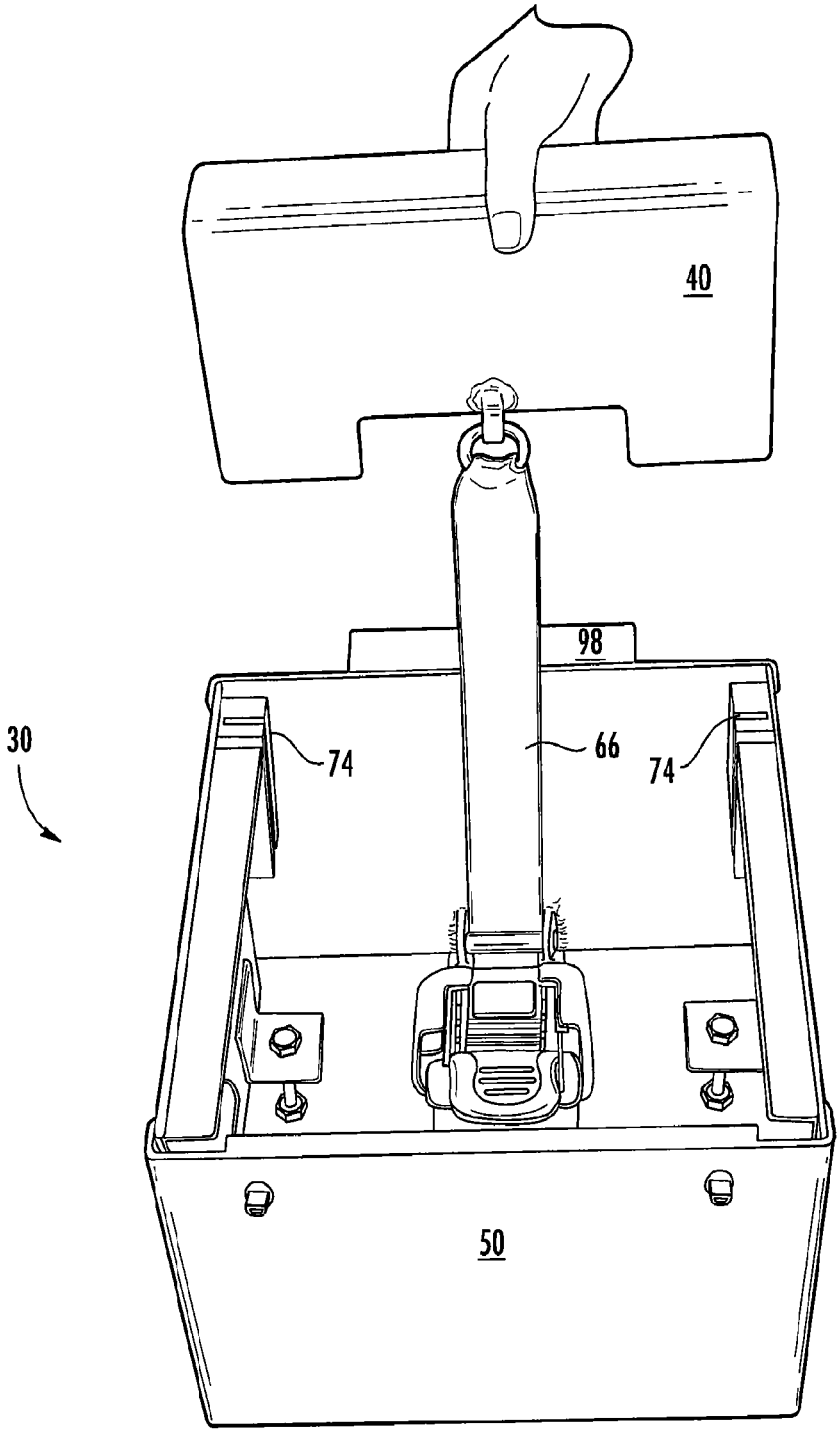
Figure 11:
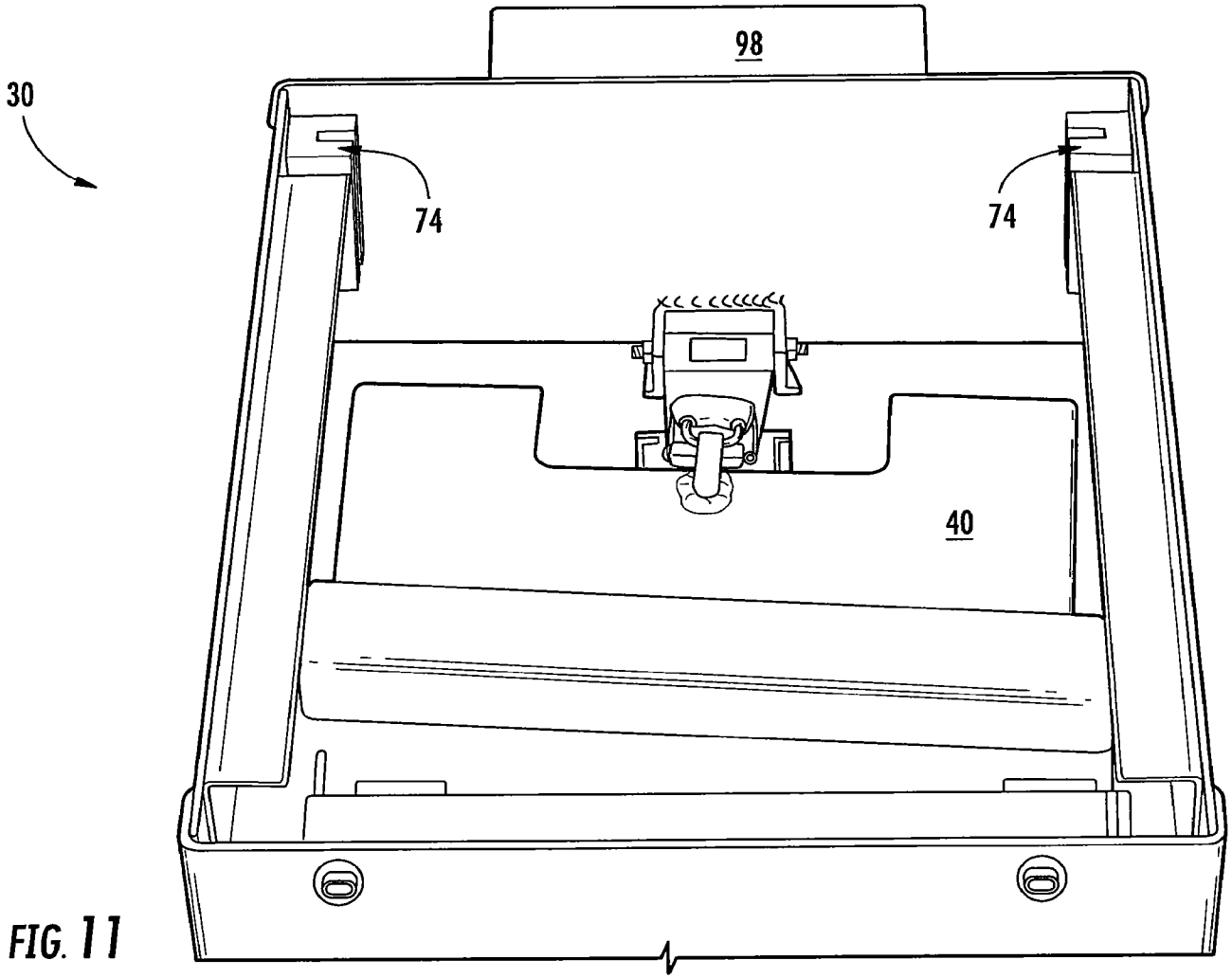

FIG. 10 illustrates how the belt 66 may be unlocked to provide enough slack so that the hook-shaped member 40 may be slid upwards and removed from the tracks 74. As illustrated in FIG. 11, the hook-shaped member 40 may then be placed generally horizontally inside the enclosure 50 below the level of the cover 52 so that the hook-shaped member 40 may be stored below grade when not in use. Also visible in FIGS. 10 and 11 is a clamping member 98 that extends from the front wall of the enclosure 50 beneath the hook portion 42 of the hook-shaped member 40. This allows the bar 12 of the goal 10 to be clamped between the hook-shaped member 40 and the clamping member 98. In some embodiments of the present invention such a clamping member 98 is not used and the bar 12 of the goal 10 is clamped between the hook-shaped member 40 and the ground 20 or some other portion of the goal securing apparatus 30.

Figure 12:
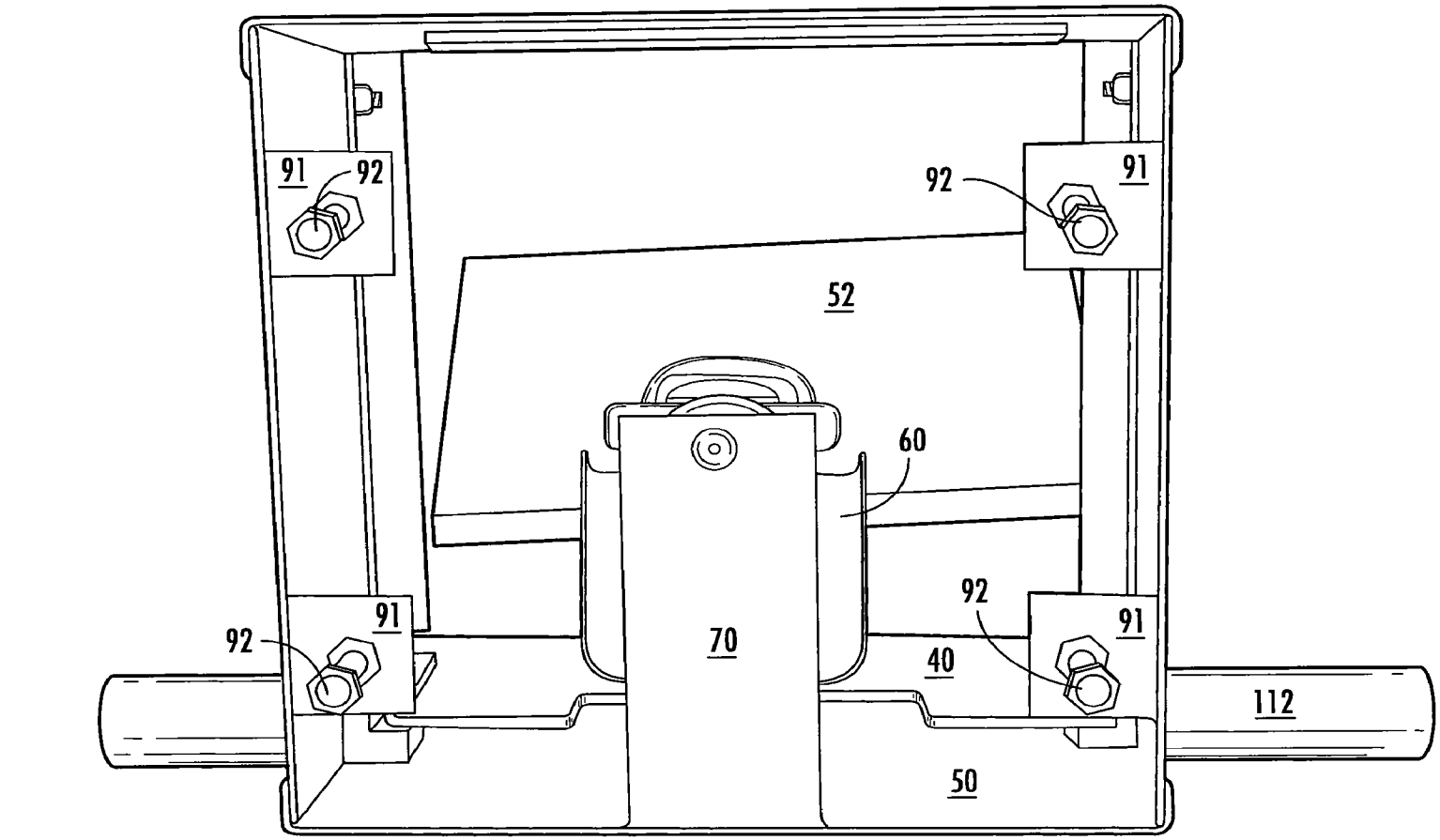

FIG. 12 illustrates a view of the bottom of the prototype goal securing apparatus 30 in accordance with an embodiment of the present invention. This view shows the angles 91, the bolts 92, and the ratcheting mechanism's support surface 70 described above.

FIG. 13 illustrates another embodiment of the present invention where a goal anchoring apparatus 130, similar to the apparatus 30 described above, is used to anchor a movable goal, such as soccer goal 10, to a football goalpost 100. As illustrated, an enclosure 150 is buried below the surface of the field 20 and a hook-shaped member 140 extends from within the enclosure above the surface of the field 20 to secure a ground bar 12 of the goal 10. The cover 52 and the enclosure 50 are configured to allow the football goalpost 100 to pass therethrough. In some embodiments, the enclosure 50 is large enough to permit the ratcheting mechanism inside the enclosure 50 to be mounted in front of the football goalpost 100. However, in other embodiments, the ratcheting device is placed on one side of the goalpost 100 or the other. In some embodiments, two ratcheting mechanisms are used to pull the hook-shaped member 140 downward, one ratcheting mechanism on either side of the goalpost 100. In still other embodiments, the hook-shaped member 40 is on tracks that are angled or essentially horizontal, so that the ratcheting mechanism pulls the hook-shaped member 140 towards the football goalpost 100 to secure the bar 12 of the soccer goal 10 between the hook-shaped member 140 and the football goalpost 100.

FIG. 14 illustrates another embodiment of the present invention where more than one goal anchoring apparatus 30 is used to anchor a goal 10. Specifically, in one embodiment, two goal anchoring apparatuses 30 are buried into the field 20 proximate to where opposite ends of the goal 10 are supposed to be located on the field 20. The goal anchoring apparatuses 30 are carefully placed and aligned with each other so that, when the bar 12 of the goal 10 is secured by both of the goal anchoring apparatuses 30, the goal 10 is automatically square with a goal on the other side of the field (which also uses two goal securing apparatuses) and/or with the end lines on the field.

Specific embodiments of the present invention are described herein. Many modifications and other embodiments of the present invention set forth herein will come to mind to one skilled in the art to which the present invention pertains having the benefit of the teachings presented in the foregoing descriptions and the associated drawings. Therefore, it is to be understood that the present invention is not to be limited to the specific embodiments disclosed and that modifications and other embodiments and combinations of embodiments are intended to be included within the scope of the appended claims. Although specific terms are employed herein, they are used in a generic and descriptive sense only and not for purposes of limitation.

What is claimed is:

1. An apparatus for releasably securing a structural member of a movable soccer goal relative to a surface, the apparatus comprising:

an enclosure structured to be placed within and substantially level with the surface, said enclosure defining a cavity and having a cover, said cover defining an aperture;

a goal engaging member movable relative to the surface and structured to engage the structural member of the movable soccer goal; and a tightening mechanism mounted entirely within said enclosure and operatively connected to said goal engaging member, said tightening mechanism comprising a rotatable member being structured to rotate in a first direction and a second direction and an elongate member extending between said rotatable member and said goal engaging member, said elongate member being secured to said goal engaging member and being structured to pass through said aperture of said cover, wherein said tightening mechanism is structured so that rotation of said rotatable member in the first direction causes the elongate member to be retrieved around the rotatable member to thereby urge said goal engaging member toward and into the interior of said enclosure so that said goal engaging member releasably secures a portion of the structural member of the movable soccer goal to the surface.

2. The apparatus of claim 1, wherein said enclosure further comprises an anchoring member extending therefrom, said anchoring member structured for anchoring said enclosure below the surface.

3. The apparatus of claim 2, wherein said anchoring member comprises:

a support member extending into said cavity of said enclosure, said support member defining an aperture; and an elongate member extending through said aperture, said elongate member defining a protuberance at the distal end thereof.

4. The apparatus of claim 1, wherein said aperture of said cover being structured so that said goal engaging member may at least partially pass through said aperture.

5. The apparatus of claim 4, wherein said enclosure further comprises a track member structured to laterally align said goal engaging member when said goal engaging member moves vertically relative to said enclosure.

6. The apparatus of claim 1, wherein said enclosure further comprises a clamping member extending outwardly from said enclosure, and wherein said tightening mechanism is configured to urge said goal engaging member toward said tightening mechanism to thereby releasably secure the portion of the structural member of the movable goal between said goal engaging member and said clamping member.

7. The apparatus of claim 1, wherein said enclosure further comprises a pedestal extending into said cavity of said enclosure, said pedestal being structured to support and releasably secure said tightening mechanism.

8. The apparatus of claim 1, wherein said rotatable member comprises a reel, said elongate member comprises a flexible belt configured to wind and unwind about said reel, and said tightening mechanism further comprises a handle configured to ratchet the reel in at least one direction.

9. The apparatus of claim 1, wherein said goal engaging member has a generally hook-shaped configuration.

10. The apparatus of claim 1, wherein said goal engaging member comprises an alignment pin extending therefrom, said alignment pin being structured to engage a corresponding aperture in a portion of the structural member of the movable goal to align the movable goal relative to said enclosure.

11. The apparatus of claim 1, wherein said enclosure is structured to receive a least a portion of a generally vertical structural member of a football goal therein, and wherein said goal engaging member is structured to engage a generally horizontal structural member of a movable soccer goal.

12. An apparatus for releasably securing a structural member of a movable soccer goal, the apparatus comprising:

an enclosure configured to be placed within and substantially level with a surface, said enclosure defining a cavity and having a cover, said cover being structured to extend across at least a portion of said enclosure, said cover comprising an aperture;

a goal engaging member movable relative to said enclosure and structured to engage the structural member of the movable soccer goal, wherein said aperture of said cover being structured so that said goal engaging member may at least partially pass through said aperture and wherein said enclosure further comprises at least one track member structured to align said goal engaging member when said goal engaging member moves relative to said enclosure; and a tightening mechanism mounted entirely within said enclosure and operatively connected to said goal engaging member, and when said goal engaging member is engaged with the structural member of the movable goal, said tightening mechanism comprising a rotatable member being structured to rotate in a first direction and a second direction and an elongate member extending between said rotatable member and said goal engaging member, said elongate member being secured to said goal engaging member, wherein said tightening mechanism is structured to urge said goal engaging member towards said enclosure to thereby releasably secure a portion of the structural member of the movable soccer goal.

13. The apparatus of claim 12, wherein said enclosure further comprises a pedestal extending into said cavity of said enclosure, said pedestal being structured to support and releasably secure said tightening mechanism.

14. The apparatus of claim 12, wherein said rotatable member comprises a reel, said elongate member comprises a flexible belt configured to wind and unwind about said reel, and said tightening mechanism further comprises a handle configured to ratchet the reel in at least one direction.

15. The apparatus of claim 12, wherein said goal engaging member has a generally hook-shaped configuration.

16. The apparatus of claim 12, wherein said goal engaging member comprises an alignment pin extending therefrom, said alignment pin being structured to engage a corresponding aperture in a portion of the structural member of the movable goal to align the movable goal relative to said enclosure.

17. The apparatus of claim 12, wherein said enclosure is structured to receive a least a portion of a generally vertical structural member of a football goal therein, and wherein said goal engaging member is structured to engage a generally horizontal structural member of a movable soccer goal.

18. The apparatus of claim 12, wherein said cover comprises a locking mechanism.

19. A method for releasably securing a structural member of a movable soccer goal, the method comprising:

placing an enclosure within and substantially level with a surface, the enclosure defining a cavity and having a cover, the cover defining an aperture;

providing a goal anchoring apparatus comprising a movable goal engaging member structured to engage the structural member of the movable goal, and a tightening mechanism operatively connected to the goal engaging member, the tightening mechanism comprising a rotatable member being structured to rotate in a first direction and a second direction and an elongate member extending between the rotatable member and the goal engaging member, the elongate member being secured to the goal engaging member and being structured to pass through the aperture of the cover, wherein the tightening mechanism is structured so that rotation of said rotatable member in the first direction causes the elongate member to be retrieved around the rotatable member;

mounting said tightening mechanism entirely within the enclosure;

positioning the goal engaging member so that the goal engaging member engages the structural member of the movable soccer goal; and rotating the rotatable member in a first direction to urge the goal engaging member towards the interior of the enclosure so that the goal engaging member releasably secures the structural member of the movable soccer goal.

20. A method of claim 19 wherein the aperture of the cover is structured so that the goal engaging member may at least partially pass through the aperture and wherein the enclosure further comprises at least one track member structured to align the goal engaging member when the goal engaging member moves relative to the enclosure and wherein the rotating step further comprises sliding the goal engaging member within the at least one track member.

* * * * *